US005533278A

United States Patent [19]

Stein

[11] Patent Number: 5,533,278

[45] **Date of Patent: *Jul. 9, 1996**

[54] SANDAL HAVING ADJUSTABLE STRAPS

[75] Inventor: Michael Stein, Yardley, Pa.

[73] Assignee: E. S. Originals, Inc., New York, N.Y.

[ * ] Notice: The term of this patent shall not extend beyond the expiration date of Pat. No. 5,438,767.

[21] Appl. No.: 434,045

[22] Filed: May 3, 1995

Related U.S. Application Data

[63] Continuation of Ser. No. 168,426, Dec. 16, 1993, Pat. No. 5,438,767.

[51] Int. Cl.[6] ..... A43B 3/12

[52] U.S. Cl. ..... 36/11.5; 36/7.5

[58] Field of Search ..... 36/11.5, 7.5, 7.6, 36/7.7, 7.8, 50.1, 45, 58.5

[56] References Cited

U.S. PATENT DOCUMENTS

| | | | |
|---|---|---|---|
| 536,812 | 4/1895 | Mabee | 36/7.5 |
| 4,353,172 | 10/1982 | Bryant | 36/7.6 |
| 4,793,075 | 12/1988 | Thatcher | 36/11.5 |
| 5,205,054 | 4/1993 | York, Jr. | 36/11.5 |
| 5,228,216 | 7/1993 | Sargeant | 36/11.5 |
| 5,438,767 | 8/1995 | Stein | 36/11.5 |

FOREIGN PATENT DOCUMENTS

| | | | |
|---|---|---|---|
| 1029166 | 6/1953 | France | 36/11.5 |
| 3825089 | 1/1990 | Germany | 36/11.5 |

*Primary Examiner*—Ted Kavanaugh
*Attorney, Agent, or Firm*—Kirschstein et al.

[57] ABSTRACT

A sandal includes a pair of heel posts on a sole, a heel strap between the heel posts, a toe post on the sole, an adjustable toe strap, and an adjustable cinch strap attached to the toe post. The cinch strap has a longitudinal portion which extends longitudinally through a heel cinch on one of the heel posts, and a transverse instep portion which thereupon extends transversely through a heel cinch on another heel post. The adjustable toe and cinch straps ensures a secure, custom fit.

8 Claims, 1 Drawing Sheet

SANDAL HAVING ADJUSTABLE STRAPS

CROSS REFERENCE TO RELATED APPLICATION

This application is a continuation of U.S. Ser. No. 08/168,426, filed Dec. 16, 1993, now U.S. Pat. No. 5,438,767.

BACKGROUND OF THE INVENTION

1. Field of the Invention

This invention generally relates to a sandal and, more particularly, to a sport sandal quickly adjustable and securely retainable on a wearer's foot even during rigorous activity.

2. Description of the Related Art

Sport sandals for active wear are known, for example, see U.S. Pat. No. 4,793,075. Although generally satisfactory for their intended purpose, the known sport sandals are disadvantageous in that multiple straps are required to be adjusted in order to achieve a secure, custom fit. For certain activities, it can be too time consuming to adjust separate heel straps, toe straps and instep straps, with the tension on one strap affecting the tension on another strap.

SUMMARY OF THE INVENTION

Objects of the Invention

It is a general object of this invention to provide a sandal which is easily and quickly adjustable and retainable in position on a wearer's foot.

Another object of this invention is to provide a comfortable sport sandal for rigorous activities.

Still another object of this invention is to provide a sport sandal having minimum straps to achieve a secure, custom fit.

Features of the Invention

In keeping with these objects and others which will become apparent hereinafter, one feature of this invention resides, briefly stated, in a sandal, which comprises a sole extending along a longitudinal direction between a toe end region and a heel end region. A pair of heel posts is spaced apart of each other along a transverse direction generally perpendicular to the longitudinal direction. Each heel post has one end attached to the sole at the heel end region, and an opposite end attached to a heel cinch. A heel strap extends generally along the transverse direction at the heel end region between heel strap ends respectively attached to a respective heel cinch.

The sandal further comprises a toe post having one end attached to the sole at the toe end region, and an opposite end attached to a toe cinch. An adjustable toe strap has one toe strap end attached to the sole at the toe end region away from the toe post, and extends generally along the transverse direction through the toe cinch, and has an opposite toe strap end looped back against the toe strap.

In accordance with this invention, an adjustable cinch strap has one cinch strap end attached to the toe post. The cinch strap extends generally along the longitudinal direction through the heel cinch on one of the heel posts, and thereupon extends generally along the transverse direction through the heel cinch on the other of the heel posts. The cinch strap has an opposite cinch strap end looped back against the cinch strap.

In the preferred embodiment, each strap is constituted of a non-stretchable, nylon webbing, and is flexible. Each post is constituted as a loop of such webbing. To achieve adjustability, the toe strap and the cinch strap are each provided with a hooked fastener section, and a complementary looped fastener section thereon.

Each heel cinch has a generally triangular shape having three sides. One side is attached to a respective heel strap end; another side is attached to a respective heel post; and still another side engages the cinch strap. The toe cinch has a generally rectangular shape having one side attached to the toe post, and another side engaging the toe strap.

Thus, in accordance with this invention, there are fewer straps that need to be adjusted, thereby simplifying and making more rapid the adjustment and retention of the sandal on the wearer's foot. This object is benefitted by making the cinch strap as a single, unitary band of flexible material whose length is longer than the length of the sole along the longitudinal direction.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENT

Figure 1:
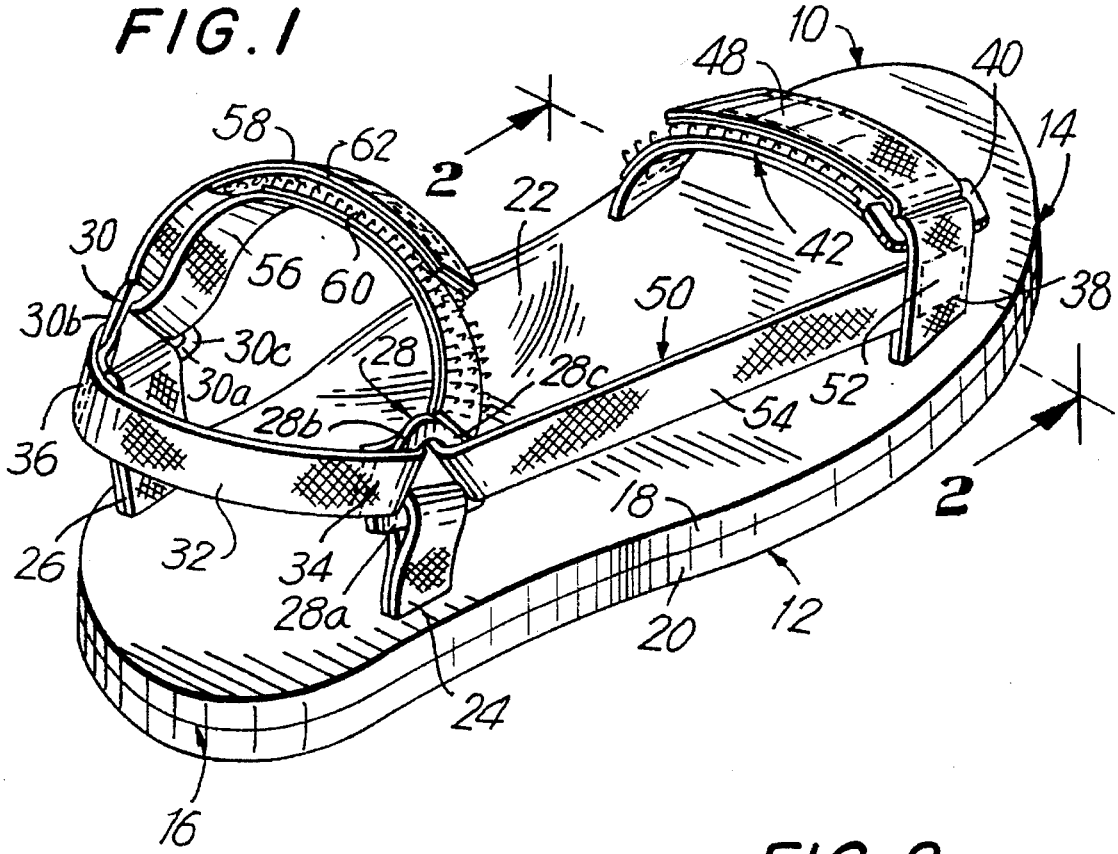
FIG. 1 is a rear perspective view a sport sandal in accordance with this invention.

Referring now to the drawings, reference numeral 10 generally identifies a sandal having an elongated sole 12 extending along a longitudinal direction between a toe end region 14 and a heel end region 16. The sole 12 is configured to the profile of a human foot, and can be constituted of a one-piece construction or, if desired, a multi-part laminated construction having an insole 18, an outsole 20 and a wedge-shaped arch insert 22 positioned midway between the toe and heel end regions.

Two heel posts 24, 26 are spaced apart of each other along a transverse direction generally perpendicular to the longitudinal direction. Each heel post is constituted of a non-stretchable, flexible, nylon webbing that is folded over itself to form a loop. The lower ends of each looped heel post are attached to, and embedded in, the sole at the heel end region. The upper looped ends of the heel posts 24, 26 are respectively attached to heel cinches 28, 30. Each heel cinch has a generally triangular shape with three sides, one side **28*a*, 30*a*** of which extends through and engages the looped ends of the heel posts.

A heel strap 32, also constituted of a flexible webbing, extends generally along the transverse direction at the heel end region between heel strap ends 34, 36 that are attached to sides **28*b*, 30*b* of the heel cinches 28, 30**, respectively. The heel strap ends are threaded through each heel cinch and folded over themselves before being sewn in place to the heel strap.

Figure 2:
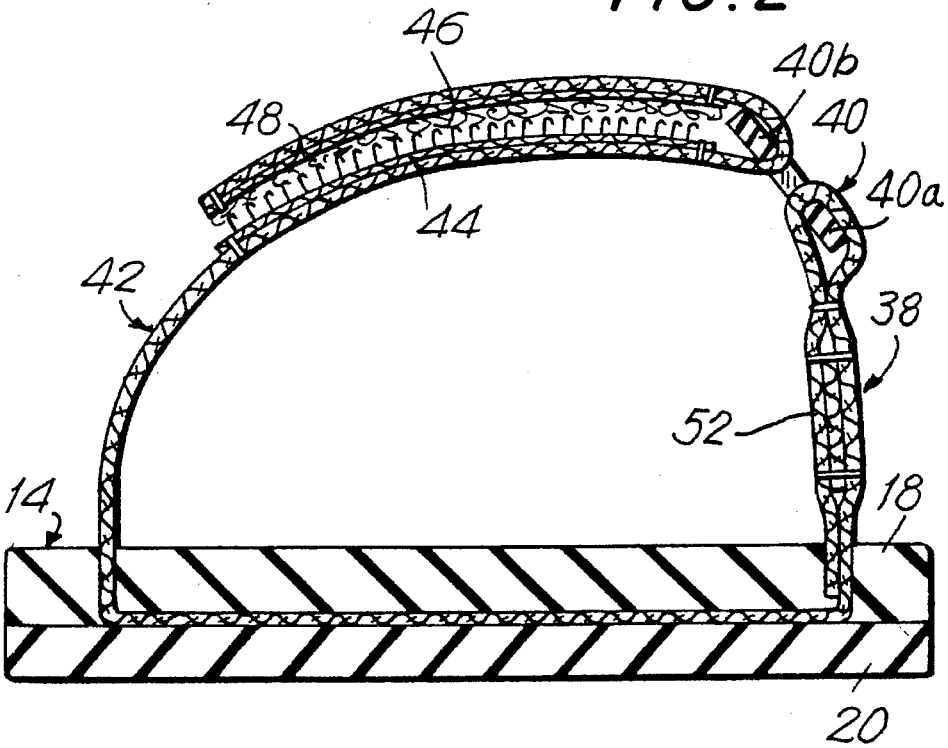
FIG. 2 is an enlarged sectional view taken along line 2—2 of FIG. 1.

As best shown in FIG. 2, a toe post 38 has one end attached to, and embedded in, the sole at the toe end region, and an opposite end attached to a toe cinch 40. The toe post 38 is constituted of the same flexible webbing, and is folded over itself to form a loop. The toe cinch 40 has a generally rectangular configuration, one side 40*a* of which extends through the loop of the toe post.

An adjustable toe strap 42 has one toe strap end attached to the sole at the toe end region away from the toe post 38. The toe strap 42 extends generally along the transverse direction through another side 40*b* of the toe cinch 40, before an opposite toe strap end 48 is folded over the toe strap. As best shown in FIG. 2, the toe post 38 and the toe strap 42 are actually formed of a single band of webbing. Also, the toe strap 42 has a hooked, VELCRO (trademark)-type, fastener section 44 on an upper surface thereof which lies underneath, and faces, a complementary looped, VELCRO-type fastener section 46 provided on a lower surface of the folded-over opposite toe strap end 48.

An adjustable cinch strap 50 has one cinch strap end 52 directly attached, e.g., by sewing, to the toe post 38. The cinch strap 50 has a longitudinal portion 54 which extends generally along the longitudinal direction adjacent and above an outer peripheral edge of the sole through the heel cinch 28 on the heel post 24. Thereupon, the cinch strap 50 is folded about side 28*c* of the heel cinch 28 and has a transverse instep portion 56 which extends generally along the transverse direction through the heel cinch 30 on the other heel post 26. The transverse instep portion 56 is thereupon folded about the side 30*c* of the heel cinch 30 to form an opposite cinch strap end 58 looped back against the transverse instep portion 56. As in the case of the toe strap, the transverse portion 56 of the cinch strap 50 has a hooked, VELCRO-type, fastener section 60 on an upper surface thereof which lies underneath, and faces, a complementary looped, VELCRO-type fastener section 62 provided on a lower surface of the opposite cinch strap end 58. The cinch strap 50 is a single, unitary band of flexible material, advantageously constituted of a non-stretchable nylon webbing, having a length longer than the length of the sole along the longitudinal direction.

To use the sandal, the wearer need only cinch the toe strap 42 and the cinch strap 50. The VELCRO-type fasteners on the toe and cinch straps ensure that these straps can be easily and quickly adjusted and re-adjusted to an infinite number of positions to achieve a secure, custom fit.

It will be understood that each of the elements described above, or two or more together, also may find a useful application in other types of constructions differing from the types described above.

While the invention has been illustrated and described as embodied in a sandal, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalents of the following claims.

What is claimed as new and desired to be protected by Letters Patent is set forth in the appended claims.

I claim:

1. A sandal, comprising:

a sole extending along a longitudinal direction between a toe end region and a heel end region;

a pair of heel posts spaced apart of each other along a transverse direction generally perpendicular to the longitudinal direction, each heel post having one end attached to the sole at the heel end region, and an opposite end attached to a heel cinch;

a heel strap extending generally along the transverse direction at the heel end region between heel strap ends respectively attached to a respective heel cinch;

a toe cinch attached to the sole at the toe end region;

an adjustable toe strap having one toe strap end attached to the sole at the toe end region away from the toe cinch, and extending generally along the transverse direction through the toe cinch, and having an opposite toe strap end looped back against the toe strap; and an adjustable cinch strap constituting a single, unitary band having a length longer than the length of the sole along the longitudinal direction, said band having a longitudinal portion and a transverse instep portion, said longitudinal portion having one cinch strap end attached to the toe strap, said longitudinal portion extending generally along the longitudinal direction through the heel cinch on one of the heel posts, said transverse instep portion having a first section extending generally along the transverse direction through the heel cinch on the other of the heel posts, said transverse instep portion being folded to form a second section extending generally along the transverse direction and overlapping the first section to a variable extent along the transverse direction, said transverse instep portion forming a loop with the heel strap, said second section having an opposite cinch strap end movable relative to said one cinch strap end for simultaneously only adjusting the effective length of the longitudinal portion and the extent of the overlap of the first and second sections.

2. The sandal according to claim 1, wherein the sole is configured to the profile of a human foot.

3. The sandal according to claim 1, wherein each strap is constituted of a non-stretchable, flexible webbing.

4. The sandal according to claim 1, wherein each post is a loop of webbing.

5. The sandal according to claim 1, wherein each adjustable strap has a hooked fastener section, and a complementary looped fastener section thereon.

6. The sandal according to claim 1, wherein each heel cinch has a generally triangular shape with three sides, one side being attached to a respective heel strap end, another side being attached to a respective heel post, and still another side engaging the cinch strap.

7. The sandal according to claim 1, wherein the cinch strap has a longitudinal portion and a transverse instep portion, and wherein the instep portion and the heel strap form a loop.

8. A sandal, comprising:

a sole extending along a longitudinal direction between a toe end region and a heel end region;

a heel assembly including a pair of heel posts spaced apart of each other along a transverse direction generally perpendicular to the longitudinal direction, each heel post having one end attached to the sole at the heel end region, and an opposite end attached to a heel cinch, and a heel strap extending generally along the transverse direction at the heel end region between heel strap ends respectively attached to a respective heel cinch;

a toe assembly including a toe cinch attached to the sole at the toe end region, and an adjustable toe strap having one toe strap end attached to the sole at the toe end region away from the toe cinch, and extending generally along the transverse direction through the toe cinch, and having an opposite toe strap end looped back against the toe strap; and an adjustable cinch strap constituting a single, unitary band having a length longer than the length of the sole along the longitudinal direction, said band having a longitudinal portion and a transverse instep portion, said longitudinal portion having one cinch strap end attached to the toe assembly, said longitudinal portion extending generally along the longitudinal direction to the heel assembly through the heel cinch on one of the heel posts, said transverse instep portion having a first section extending generally along the transverse direction through the heel cinch on the other of the heel posts, said transverse instep portion being folded to form a second section extending generally along the transverse direction and overlapping the first section to a variable extent along the transverse direction, said transverse instep portion forming a loop with the heel strap, said second section having an opposite cinch strap end movable relative to said one cinch strap end for simultaneously only adjusting the effective length of the longitudinal portion and the extent of the overlap of the first and second sections.

* * * * *